US010405122B1

(12) United States Patent
Jang et al.

(10) Patent No.: US 10,405,122 B1
(45) Date of Patent: Sep. 3, 2019

(54) STEREOPHONIC SOUND GENERATING METHOD AND APPARATUS USING MULTI-RENDERING SCHEME AND STEREOPHONIC SOUND REPRODUCING METHOD AND APPARATUS USING MULTI-RENDERING SCHEME

(71) Applicant: Electronics and Telecommunications Research Institute, Daejeon (KR)

(72) Inventors: Dae Young Jang, Daejeon (KR); Yong Ju Lee, Daejeon (KR); Jae-hyoun Yoo, Daejeon (KR); Sang Won Suh, Daejeon (KR)

(73) Assignee: Electronics and Telecommunications Research Institute, Daejeon (KR)

( * ) Notice: Subject to any disclaimer, the term of this patent is extended or adjusted under 35 U.S.C. 154(b) by 0 days.

(21) Appl. No.: 15/984,490

(22) Filed: May 21, 2018

(30) Foreign Application Priority Data

Feb. 13, 2018 (KR) ..... 10-2018-0017653

(51) Int. Cl.
*H04S 7/00* (2006.01)

(52) U.S. Cl.
CPC ..... *H04S 7/30* (2013.01); *H04S 2400/01* (2013.01)

(58) Field of Classification Search
CPC ..... H04S 7/30; H04S 2400/01
USPC ..... 381/1, 17, 18, 73.1, 303, 307
See application file for complete search history.

(56) References Cited

U.S. PATENT DOCUMENTS

| | | | | |
|---|---|---|---|---|
| 10,021,504 | B2 * | 7/2018 | Chon | H04S 3/008 |
| 2009/0252356 | A1 * | 10/2009 | Goodwin | G10L 19/173 381/310 |
| 2011/0150098 | A1 | 6/2011 | Lee et al. | |
| 2013/0106997 | A1 | 5/2013 | Kim et al. | |
| 2015/0030160 | A1 | 1/2015 | Lee et al. | |
| 2015/0332680 | A1 * | 11/2015 | Crockett | G10L 19/008 381/23 |
| 2016/0006879 | A1 * | 1/2016 | Dickins | H04M 9/085 379/406.03 |
| 2016/0150345 | A1 | 5/2016 | Jang | |
| 2017/0064485 | A1 | 3/2017 | Song et al. | |
| 2017/0094440 | A1 * | 3/2017 | Brown | H04S 7/30 |
| 2017/0243596 | A1 * | 8/2017 | Eggerding | G10L 19/008 |
| 2018/0115849 | A1 * | 4/2018 | Breebaart | H04S 7/30 |
| 2018/0152803 | A1 * | 5/2018 | Seefeldt | H04S 7/30 |

FOREIGN PATENT DOCUMENTS

KR 10-0542129 B1 1/2006

* cited by examiner

*Primary Examiner* — Paul Kim
*Assistant Examiner* — Friedrich Fahnert
(74) *Attorney, Agent, or Firm* — NSIP Law

(57) ABSTRACT

Provided is a stereophonic sound reproducing apparatus that applies a multi-rendering scheme to a channel sound signal and an object sound signal to enhance a stereophonic effect. A stereophonic sound reproducing method performed by the stereophonic sound reproducing apparatus may include receiving a channel sound signal based on a channel, an object sound signal based on an object, and metadata, and reproducing the channel sound signal based on a preset rendering scheme and reproducing, based on the metadata including a rendering scheme determined using the object sound signal, each object sound signal using the determined rendering scheme.

13 Claims, 8 Drawing Sheets

STEREOPHONIC SOUND GENERATING METHOD AND APPARATUS USING MULTI-RENDERING SCHEME AND STEREOPHONIC SOUND REPRODUCING METHOD AND APPARATUS USING MULTI-RENDERING SCHEME

CROSS-REFERENCE TO RELATED APPLICATION(S)

This application claims the priority benefit of Korean Patent Application No. 10-2018-0017653 filed on Feb. 13, 2018, in the Korean Intellectual Property Office, the disclosure of which is incorporated herein by reference for all purposes.

BACKGROUND

1. Field

One or more example embodiments relate to stereophonic sound generating apparatus and method, and stereophonic sound reproducing apparatus and method using a multi-rendering scheme, and more particularly, to a method and apparatus using a multi-rendering scheme to provide an enhanced stereophonic effect.

2. Description of Related Art

Recently, there has been an increasing tendency to provide more immersive stereophonic sound such as an ultra-high definition (UHD) TV, a virtual reality (VR) game/attraction and the like based on a digital cinema. In terms of the digital cinema, Barco's AURO-3D in Europe has attempted to provide hemispherical stereo sound by adding four channels on a ceiling to the existing 5.1 channel, whereby there has been provided an opportunity to express not only stereo sound on a horizontal plane but also stereo sound on a vertical plane. Thereafter, Dolby recognized a limitation of a multi-channel-based audio format and thus, has commercialized Atmos technology that can adapt to various audio playback environments by introducing audio technology of a hybrid format including an object-based audio format. DTS has also entered a movie and home theater market using DTS:X technology similar to the Atmos technology, and is competing with Dolby in realistic media such as VR.

Standardization organizations also establish standardizations of such hybrid format audio technology. Audio definition model (ADM) of the International Telecommunication Union (ITU) defines metadata that represents information in various audio formats including an object-based audio format. Advanced Television Systems Committee (ATSC) 3.0, the next generation broadcasting standard in the United States, standardized to include audio technology of the hybrid format and specifies that Dolby AC-4 and Moving Picture Experts Group (MPEG)-H 3D Audio technologies can be selectively used.

As such, although the standardization and the technology development have been made so that the audio technology of the hybrid format can be serviced, the technologies depend on one of the existing rendering methods, and thus may not reproduce the immersive stereo sound.

SUMMARY

An aspect provides a method and an apparatus applying a multi-rendering scheme to a channel sound signal and an object sound signal to enhance a stereophonic effect.

Another aspect also provides a method and apparatus for reproducing an object sound signal using a corresponding rendering scheme based on metadata to enhance a stereophonic effect.

Still another aspect also provides a method and apparatus for correcting a sound volume, a sound tone, and a latency in response to a multi-rendering scheme being applied, to enhance a stereophonic effect.

According to an aspect, there is provided a stereophonic sound reproducing method performed by a stereophonic sound reproducing apparatus, the method including receiving a channel sound signal based on a channel, an object sound signal based on an object, and metadata and reproducing the channel sound signal based on a preset rendering scheme and reproducing, based on the metadata including a rendering scheme determined using the object sound signal, each object sound signal using the determined rendering scheme.

The determined rendering scheme may be changed on a time-by-time basis while the object sound signal is reproduced.

The reproducing may include compensating for a latency due to a difference in rendering scheme of each object sound signal.

The reproducing may include correcting a tone and a volume changing due to a difference in rendering scheme of each object sound signal.

The preset rendering scheme of the channel sound signal may include a channel format for reproducing the channel sound signal, and the channel format may be converted based on a reproduction environment.

According to another aspect, there is also provided a stereophonic sound generating method performed by a stereophonic sound generating apparatus, the method including identifying a channel sound signal based on a channel and an object sound signal based on an object and generating metadata including a rendering scheme determined based on the identified object sound signal.

The determined rendering scheme may be changed on a time-by-time basis while the object sound signal is reproduced.

The determined rendering scheme may be changed based on a movement of an object corresponding to a target of the object sound signal.

According to still another aspect, there is also provided a stereophonic sound reproducing apparatus including a processor configured to receive a channel sound signal based on a channel, an object sound signal based on an object, and metadata and reproduce the channel sound signal based on a preset rendering scheme and reproduce, based on the metadata including a rendering scheme determined using the object sound signal, each object sound signal using the determined rendering scheme.

The processor may be configured to change the determined rendering scheme is changed on a time-by-time basis while the object sound signal is reproduced.

When reproducing each object sound signal, the processor may be configured to compensate for a latency due to a difference in rendering scheme of each object sound signal.

When reproducing each object sound signal, the processor may be configured to correct a tone and a volume changing due to a difference in rendering scheme of each object sound signal.

The processor may be configured to perform conversion, based on a reproduction environment, on a channel format included in the preset rendering scheme of the channel sound signal.

According to yet another aspect, there is also provided a stereophonic sound generating apparatus including a processor configured to identify a channel sound signal based on a channel and an object sound signal based on an object and generate metadata including a rendering scheme determined based on the identified object sound signal.

The processor may be configured to change the determined rendering scheme is changed on a time-by-time basis while the object sound signal is reproduced.

The processor may be configured to change the determined rendering scheme based on a movement of an object corresponding to a target of the object sound signal.

According to an aspect, it is possible to provide a method and an apparatus applying a multi-rendering scheme to a channel sound signal and an object sound signal to enhance a stereophonic effect.

According to another aspect, it is possible to provide a method and apparatus for reproducing an object sound signal using a corresponding rendering scheme based on metadata to enhance a stereophonic effect.

According to still another aspect, it is possible to provide a method and apparatus for correcting a sound volume, a sound tone, and a latency in response to a multi-rendering scheme being applied, to enhance a stereophonic effect.

Additional aspects of example embodiments will be set forth in part in the description which follows and, in part, will be apparent from the description, or may be learned by practice of the disclosure.

BRIEF DESCRIPTION OF THE DRAWINGS

These and/or other aspects, features, and advantages of the invention will become apparent and more readily appreciated from the following description of example embodiments, taken in conjunction with the accompanying drawings of which.

DETAILED DESCRIPTION

Hereinafter, example embodiments will be described in detail with reference to the accompanying drawings.

It should be understood, however, that there is no intent to limit this disclosure to the particular example embodiments disclosed. On the contrary, example embodiments are to cover all modifications, equivalents, and alternatives falling within the scope of the example embodiments.

Although terms such as "first," "second," and "third" may be used herein to distinguish one member, component, region, layer, or section from another member, component, region, layer, or section. Thus, a first member, component, region, layer, or section referred to in examples described herein may also be referred to as a second member, component, region, layer, or section without departing from the teachings of the examples.

Throughout the specification, when an element, such as a layer, region, or substrate, is described as being "on," "connected to," or "coupled to" another element, it may be directly "on," "connected to," or "coupled to" the other element, or there may be one or more other elements intervening therebetween.

The terminology used herein is for describing various examples only, and is not to be used to limit the disclosure. The articles "a," "an," and "the" are intended to include the plural forms as well, unless the context clearly indicates otherwise. The terms "comprises," "includes," and "has" specify the presence of stated features, numbers, operations, members, elements, and/or combinations thereof, but do not preclude the presence or addition of one or more other features, numbers, operations, members, elements, and/or combinations thereof.

Unless otherwise defined, all terms, including technical and scientific terms, used herein have the same meaning as commonly understood by one of ordinary skill in the art to which this disclosure pertains. Terms, such as those defined in commonly used dictionaries, are to be interpreted as having a meaning that is consistent with their meaning in the context of the relevant art, and are not to be interpreted in an idealized or overly formal sense unless expressly so defined herein.

Figure 1:
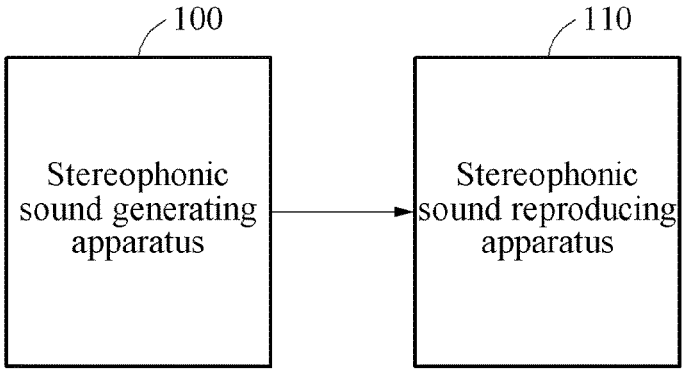
FIG. 1 is a diagram illustrating a stereophonic sound generating apparatus and a stereophonic sound reproducing apparatus according to an example embodiment.

FIG. 1 is a diagram illustrating a stereophonic sound generating apparatus and a stereophonic sound reproducing apparatus according to an example embodiment.

A stereophonic sound generating apparatus 100 may determine a rendering scheme of a channel sound signal and an object sound signal. A stereophonic sound reproducing apparatus 110 may receive the rendering scheme determined by the stereophonic sound generating apparatus 100 and reproduce the channel sound signal and the object sound signal. The stereophonic sound reproducing apparatus 110 may reproduce the channel sound signal and the object sound signal with a stereophonic effect. The stereophonic sound reproducing apparatus 110 may reproduce the channel sound signal and the object sound signal using at least one reproducing scheme.

The stereophonic sound generating apparatus 100 may identify at least one sound signal. The sound signal may include, for example, a channel sound signal that is based on a channel and an object sound signal that is based on an object.

The channel sound signal may be reproduced based on, for example, a multi-channel rendering scheme. The object sound signal may be reproduced based on, for example, a multi-channel rendering scheme by panning, a binaural rendering scheme, a transoral rendering scheme, a sound field synthesis rendering method, and other multi-channel rendering methods. In addition to the aforementioned rendering schemes, various rendering scheme may also be applied to reproduce the channel sound signal and the object sound signal.

The stereophonic sound generating apparatus 100 may determine a rendering scheme of the object sound signal by applying a characteristic of the object sound signal. The characteristic of the object sound signal may include a change in object sound signal over time and a change in object sound signal due to other causes. For example, when a position of the object sound signal is changed on a time-by-time basis, the object sound signal may be reproduced using different rendering schemes on the time-by-time basis.

The stereophonic sound generating apparatus 100 may generate metadata including a rendering scheme reflecting the characteristic of the object sound signal. For example, the stereophonic sound generating apparatus 100 may generate metadata including a method of reproducing the object sound signal using the binaural rendering scheme.

The stereophonic sound generating apparatus 100 may identify an object sound signal reproduced using a rendering scheme based on a moving trajectory of metadata and a channel sound signal reproduced using a preset rendering scheme, and generate metadata. Also, the stereophonic sound reproducing apparatus 110 may generate a signal to be reproduced by receiving the channel sound signal, the object sound signal, and the metadata. The preset rendering scheme of the channel sound signal may include the multi-channel rendering scheme and a number of channels may vary based on a reproduction environment.

Figure 2:
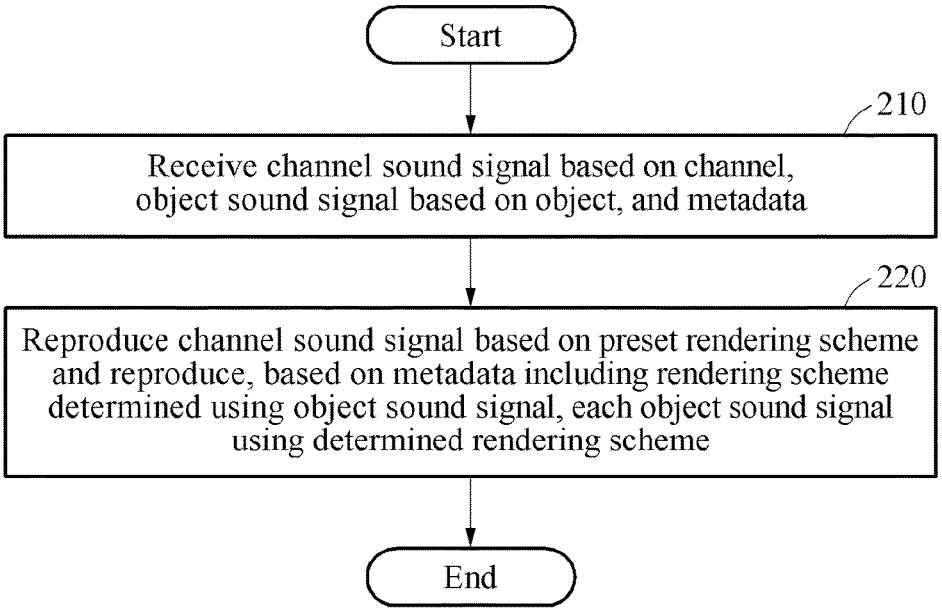
FIG. 2 is a diagram illustrating a stereophonic sound reproducing method performed by a stereophonic sound reproducing apparatus according to an example embodiment.

FIG. 2 is a diagram illustrating a stereophonic sound reproducing method performed by a stereophonic sound reproducing apparatus according to an example embodiment.

In operation 210, a stereophonic sound reproducing apparatus may receive a channel sound signal that is based on a channel, an object sound signal that is based on an object, and metadata. The stereophonic sound reproducing apparatus may include a processor and the stereophonic sound reproducing method may be performed by the processor.

In an example, a channel sound signal may include a sound signal different from an object sound signal. For example, in waterfall sound, bird's sound and bee's sound may be the object sound signal and background sound such as wind sound and water sound may be the channel sound signal.

In another example, an object sound signal may be a sound signal generated at a target object of sound. For example, when broadcasting a football game, sound of people may be a channel sound signal, sound of a reporter 1 may be an object sound signal 1, and sound of a reporter 2 may be an object sound signal 2. In this example, when the sound of the people and the sound of the reporters are channel sound signals, sound of player and sound of judge may be object sound signals.

As such, the channel sound signal and the object sound signal may vary based on a situation. The channel sound signal and the object sound signal may vary based on a selection of a user. For example, sound selected by the user may be the object sound signal and sound unselected by the user may be the channel sound signal.

The stereophonic sound reproducing apparatus may reproduce the object sound signal based on metadata. The metadata may include positional information such as a direction of a sound source and a distance from the sound source changing temporally, for example, information on a movement trajectory in addition to a rendering scheme of the object sound signal.

A rendering scheme of the channel sound signal may be determined based on a listening environment set by the user. For example, the channel sound signal may be converted into an audio format of a reproduction device selected by the user so as to be reproduced and thus, the rendering scheme of the channel sound signal may not be transmitted using the metadata.

In operation 220, the stereophonic sound reproducing apparatus may reproduce the channel sound signal based on a preset rendering scheme and reproducing, based on the metadata including a rendering scheme determined using the object sound signal, each object sound signal using the determined rendering scheme.

The stereophonic sound reproducing apparatus may reproduce the channel sound signal using a present rendering scheme. In an example, the channel sound signal may be sound of people or background sound, for example, water and wind sound. Also, the channel sound signal may be reproduced using a preset multi-channel rendering scheme. The rendering scheme may include the multi-channel rendering scheme and other rendering schemes. As such, the stereophonic sound generating apparatus may previously set the rendering scheme of the channel sound signal. Also, the stereophonic sound reproducing apparatus may receive the channel sound signal, the object sound signal, and the metadata.

The rendering scheme set for the channel sound signal in the stereophonic sound generating apparatus may be changed based on a reproduction environment of the stereophonic sound reproducing apparatus. For example, the stereophonic sound generating apparatus may set a 22.2 channel format as the rendering scheme to be used for reproducing the background sound corresponding to the channel sound signal and the stereophonic sound reproducing apparatus may use a 5.1 channel format. In this example, a channel format may be converted based on the reproduction environment of the stereophonic sound reproducing apparatus. Thus, the stereophonic sound reproducing apparatus may reproduce the channel sound signal using the 5.1 channel format instead of the 22.2 channel format. When the channel format of the background sound corresponding to the channel sound signal is different from an arrangement of a speaker for reproducing the channel sound signal, the stereophonic sound reproducing apparatus may reproduce the background sound by converting the channel format of the background sound to be adaptive to the arrangement of the speaker.

When the rendering scheme set in the stereophonic sound generating apparatus is inapplicable to the stereophonic sound reproducing apparatus, the stereophonic sound reproducing apparatus may convert the rendering scheme based on the reproduction scheme to reproduce the channel sound signal. In this example, the reproduction environment may include the channel format and other elements required for reproduction.

The stereophonic sound reproducing apparatus may reproduce each object sound signal using a rendering scheme determined based on a characteristic of the corresponding object sound signal. The object sound signal may be, for example, sound of reporter in a football game, bird's sound, or bee's sound. The object sound signal may be reproduced using a rendering scheme included in metadata. The rendering scheme may include, for example, a multi-channel rendering scheme by panning and other multi-channel rendering schemes, a binaural rendering scheme, a sound field synthesis rendering scheme, a transoral rendering scheme. The stereophonic sound generating apparatus may determine the rendering scheme of the object sound signal such that the metadata including the determined rendering scheme is transmitted to the stereophonic sound reproducing apparatus.

For example, in a forest, a user may listen to wind sound and water sound as background sound, bird's sound behind the user, and bee's sound around a head of the user. In this example, the background sound may be the channel sound signal, and the bird's sound and the bee's sound may be the object sound signal. When reproducing the channel sound signal and the object sound signal in the stereophonic sound reproducing apparatus that uses a 5.1 channel format, the channel sound signal and the object sound signal may be reproduced while a factor such as a distance and a time is not applied. In this example, the stereophonic sound reproducing apparatus may reproduce each of the wind sound, the water sound, the bird's sound, and the bee's sound using at least one rendering scheme based on a corresponding characteristic.

Specifically, to enhance a stereophonic effect, the wind sound and the water sound corresponding to channel sound signals and the bird's sound corresponding to an object sound signal may be reproduced using a multi-channel rendering scheme and the bee's sound corresponding to another object sound signal may be reproduced using a binaural rendering scheme.

The stereophonic sound reproducing apparatus may reproduce the object sound signal using at least one rendering scheme by applying a characteristic of the object sound signal. The characteristic of the object sound signal may include, for example, a change in distance and a change in frequency over time.

When a distance from the object sound signal changes over time, the stereophonic sound reproducing apparatus may reproduce the object sound signal using a different rendering scheme based on a preset distance. The preset distance may change based on, for example, the characteristic of the object sound signal. In this example, a sound volume of the object sound signal may also be applied in addition to the distance from the object sound signal.

In terms of sound with a relatively small volume, for example, the bee's sound, different rendering schemes may be applied based on a preset distance. In terms of sound with a relatively large volume such as sound of explosion, since the sound volume is large even when a distance from a sound source is far, the rendering scheme may be determined based on the sound volume.

In this example, far-off sound and nearby sound may share a predetermined interval based on the present distance. The far-off sound may be processed by fade-out and the nearby sound may be processed by fade-in whereby the rendering scheme is changed smoothly. A far-off sound source and a nearby sound source may be managed using separate tracks such that a single rendering scheme is applied to each of the tracks. In terms of an object sound signal coming closer, a single track may be copied and a track corresponding to the multi-channel rendering scheme and/or the binaural rendering scheme may be used based on a distance.

When a distance from the bee's sound corresponding to the object sound signal changes due to a movement of a bee over time, different rendering schemes may be used for the bee's sound on a time-by-time basis. For example, the bee's sound may change while the bee is coming close. In this example, the bee's sound farther than a preset distance may be reproduced using a multi-channel rendering scheme by panning. Also, the bee's sound within the preset distance may be reproduced using a binaural rendering scheme. When a predetermined interval is shared based on the preset distance, the farther bee's sound may be processed by fade-out and the bee's sound in the preset distance may be processed by fade-in.

The stereophonic sound reproducing apparatus may reproduce an object sound signal based on a movement trajectory of metadata including a corresponding rendering scheme. Because the object sound signal represents a sound signal, information such as location information and rendering information of the object sound signal may be transmitted as the metadata. In this example, the location information may be changed on the time-by-time basis.

A rendering scheme used for reproducing each object sound signal may cause a difference. The difference may include a latency, a sound volume, and a sound tone but not limited thereto.

When reproducing the same object sound signal using different rendering schemes on the time-by-time basis, the stereophonic sound reproducing apparatus receiving the related information may correct, for example, compensate for a latency caused due to a difference in rendering scheme. Also, when reproducing different object sound signals using different schemes, the stereophonic sound reproducing apparatus may compensate for a latency caused due to a difference in rendering scheme. For example, a latency caused due to a distance between a speaker and a listener in a listening environment may be corrected by adding the latency to the binaural rendering scheme.

When reproducing the same object sound signal using different rendering schemes on the time-by-time basis, the stereophonic sound reproducing apparatus receiving the related information may correct, through equalization, a sound tone changing due to a difference in rendering scheme. Also, when reproducing different object sound signals using different schemes, the stereophonic sound reproducing apparatus may correct, through the equalization, a sound tone changing due to a difference in rendering scheme.

When reproducing the same object sound signal using different rendering schemes on the time-by-time basis, the stereophonic sound reproducing apparatus receiving the related information may correct a sound volume changing due to a difference in rendering scheme. Also, when reproducing different object sound signals using different schemes, the stereophonic sound reproducing apparatus may correct a sound volume changing due to a difference in rendering scheme.

In this example, the stereophonic sound reproducing apparatus may correct the sound volume using a preset reference signal such that the sound volume reproduced using each of the rendering schemes is equalized. The preset reference signal may be determined by applying a characteristic of the object sound signal. For example, a user may control a sound signal using a corresponding rendering scheme based on a preset reference signal while listening sound. Also, the stereophonic sound reproducing apparatus may automatically control a sound signal using a corresponding rendering scheme based on a preset reference signal such that a relative level and/or volume of the sound signal is maintained.

When the rendering scheme set in the stereophonic sound generating apparatus is inapplicable to the stereophonic sound reproducing apparatus, the stereophonic sound reproducing apparatus may reproduce the channel sound signal and the object sound signal using an available rendering scheme. For example, when the 22.2 multi-channel rendering scheme and the binaural rendering scheme are determined in the stereophonic sound generating apparatus and the 5.1 multi-channel rendering scheme is available in the stereophonic sound reproducing apparatus, the stereophonic sound reproducing apparatus may reproduce the channel sound signal and the object sound signal using the 5.1 multi-channel rendering scheme. As such, when the rendering scheme determined in the stereophonic sound generating apparatus is not to be used, the rendering scheme may be converted into a rendering scheme available in the stereophonic sound reproducing apparatus so as to be used for reproducing the channel sound signal and the object sound signal.

Figure 3:
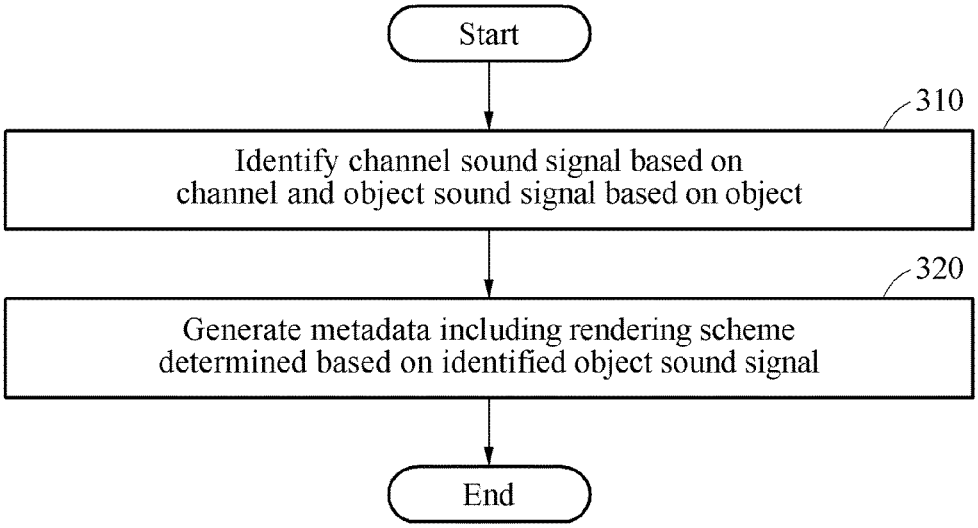
FIG. 3 is a diagram illustrating a stereophonic sound generating method performed by a stereophonic sound generating apparatus according to an example embodiment.

FIG. 3 is a diagram illustrating a stereophonic sound generating method performed by a stereophonic sound generating apparatus according to an example embodiment.

In operation 310, the stereophonic sound generating apparatus may identify a channel sound signal that is based on a channel and an object sound signal that is based on an object. The stereophonic sound generating apparatus may include a processor and the processor may perform the stereophonic sound generating method.

The channel sound signal may include a sound signal different from the object sound signal. For example, in a soap opera, conversation of characters may correspond to object sound signals and background sound such as car sound may correspond to a channel sound signal.

The object sound signal may be a sound signal generated at a target object of sound. For example, when broadcasting a football game, sound of people may be a channel sound signal, sound of a reporter 1 may be an object sound signal 1, and sound of a reporter 2 may be an object sound signal 2. In this example, when the sound of the people and the sound of the reporters are channel sound signals, sound of player and sound of judge may be object sound signals.

As such, the channel sound signal and the object sound signal may vary based on a situation. The channel sound signal and the object sound signal may vary based on a selection of a user. For example, sound selected by the user may be the object sound signal and sound unselected by the user may be the channel sound signal.

In operation 320, the stereophonic sound generating apparatus may generate metadata including a rendering scheme determined based on the object sound signal. The metadata may include the rendering scheme of the object sound signal and other information.

The metadata may include, for example, a binaural rendering scheme corresponding to a rendering scheme of the object sound signal 1 and a multi-channel rendering scheme by panning corresponding to a rendering scheme of the object sound signal 2.

The channel sound signal may be transmitted to the stereophonic sound reproducing apparatus such that the stereophonic sound reproducing apparatus reproduces the channel sound signal using a preset rendering scheme. The channel sound signal may be the sound of the people or the background sound such as the car sound. The channel sound signal may be reproduced using a preset multi-channel rendering scheme. In this example, the rendering scheme may include the multi-channel rendering scheme and other rendering schemes. When the stereophonic sound generating apparatus may set a rendering scheme for the channel sound signal, the stereophonic sound reproducing apparatus may receive the channel sound signal and reproduce the channel sound signal.

The rendering scheme set for the channel sound signal in the stereophonic sound generating apparatus may be changed based on a reproduction environment of the stereophonic sound reproducing apparatus. For example, the stereophonic sound generating apparatus may set a 22.2 channel format as the rendering scheme to be used for reproducing the background sound corresponding to the channel sound signal and the stereophonic sound reproducing apparatus may use a 5.1 channel format. In this example, a channel format may be converted based on the reproduction environment of the stereophonic sound reproducing apparatus. Thus, the stereophonic sound reproducing apparatus may reproduce the channel sound signal using the 5.1 channel format instead of the 22.2 channel format. When the channel format of the background sound corresponding to the channel sound signal is different from an arrangement of a speaker for reproducing the channel sound signal, the stereophonic sound reproducing apparatus may reproduce the background sound by converting the channel format of the background sound to be adaptive to the arrangement of the speaker.

The stereophonic sound reproducing apparatus may determine a rendering scheme based on a characteristic of the corresponding object sound signal. The object sound signal may be, for example, sound of reporter in a football game or sound of conversation between characters in a movie. The object sound signal may be reproduced using a rendering scheme included in metadata. The rendering scheme may include, for example, a multi-channel rendering scheme by panning and other multi-channel rendering schemes, a binaural rendering scheme, a sound field synthesis rendering scheme, a transoral rendering scheme. The stereophonic sound generating apparatus may determine the rendering scheme of the object sound signal and transmit metadata including the determined rendering scheme to the stereophonic sound reproducing apparatus.

For example, in the movie, the background sound may include car sound, sound of people, and sound of main characters 1, 2, and 3. In this example, the background sound may correspond to a channel sound signal and the sound of the main characters 1, 2, and 3 may correspond to object sound signals. When reproducing the channel sound signal and the object sound signal in the stereophonic sound reproducing apparatus that uses the 5.1 channel format, the channel sound signal and the object sound signal may be reproduced while a factor such as a distance and a time is not applied. In this example, the stereophonic sound reproducing apparatus may receive related information from the stereophonic sound generating apparatus and reproduce each of the background sound and the sound of the main characters 1, 2, and 3 using at least one rendering scheme based on a corresponding characteristic.

Specifically, to enhance a stereophonic effect, the car sound corresponding to the channel sound signal and the sound of the main character 1 corresponding to the object sound signal may be reproduced using a multi-channel rendering scheme and the sound of the main character 2 corresponding to another object sound signal may be reproduced using a binaural rendering scheme.

In response to the related information being received, the stereophonic sound reproducing apparatus may reproduce the object sound signal using at least one rendering scheme by applying a characteristic of the object sound signal. The characteristic of the object sound signal may include, for example, a change in distance and a change in frequency over time.

When a distance from the object sound signal changes over time, the stereophonic sound reproducing apparatus may reproduce the object sound signal using a different rendering scheme based on a preset distance. In this example, far-off sound and nearby sound may share a predetermined interval based on the present distance. The far-off sound may be processed by fade-out and the nearby sound may be processed by fade-in whereby the rendering scheme is changed smoothly.

When a distance from the sound of the main character 1 corresponding to the object sound signal changes due to a movement of the main character 1 over time, different rendering schemes may be used for the sound of the main character 1 on a time-by-time basis. For example, the sound of the main character 1 may change while the main character 1 is coming close. In this example, the sound of the main character 1 farther than a preset distance may be reproduced using the multi-channel rendering scheme by panning. Also, the sound of the main character 1 within the preset distance may be reproduced using the binaural rendering scheme. When a predetermined interval is shared based on the preset distance, the farther sound of the main character 1 may be processed by fade-out and the sound of the main character 1 in the preset distance may be processed by fade-in.

The stereophonic sound reproducing apparatus receiving the related information may reproduce an object sound signal based on a movement trajectory of metadata including a corresponding rendering scheme.

A rendering scheme used for reproducing each object sound signal may cause a difference. The difference may include a latency, a sound volume, and a sound tone but not limited thereto.

When reproducing the same object sound signal using different rendering schemes on the time-by-time basis, the stereophonic sound reproducing apparatus receiving the related information may correct, for example, compensate for a latency caused due to a difference in rendering scheme. Also, when reproducing different object sound signals using different schemes, the stereophonic sound reproducing apparatus may compensate for a latency caused due to a difference in rendering scheme. For example, a latency caused due to a distance between a speaker and a listener in a listening environment may be corrected by adding the latency to the binaural rendering scheme.

When reproducing the same object sound signal using different rendering schemes on the time-by-time basis, the stereophonic sound reproducing apparatus receiving the related information may correct, through equalization, a sound tone changing due to a difference in rendering scheme. Also, when reproducing different object sound signals using different schemes, the stereophonic sound reproducing apparatus may correct, through the equalization, a sound tone changing due to a difference in rendering scheme.

When reproducing the same object sound signal using different rendering schemes on the time-by-time basis, the stereophonic sound reproducing apparatus receiving the related information may correct a sound volume changing due to a difference in rendering scheme. Also, when reproducing different object sound signals using different schemes, the stereophonic sound reproducing apparatus may correct a sound volume changing due to a difference in rendering scheme. In this example, the stereophonic sound reproducing apparatus may correct the sound volume using a preset reference signal such that the sound volume reproduced using each rendering scheme is equalized. The preset reference signal may be determined by applying a characteristic of the object sound signal.

When the rendering scheme set in the stereophonic sound generating apparatus is inapplicable to the stereophonic sound reproducing apparatus, the stereophonic sound reproducing apparatus may reproduce the channel sound signal and the object sound signal using an available rendering scheme. For example, when the 22.2 multi-channel rendering scheme and the binaural rendering scheme are determined in the stereophonic sound generating apparatus and the 5.1 multi-channel rendering scheme is available in the stereophonic sound reproducing apparatus, the stereophonic sound reproducing apparatus may reproduce the channel sound signal and the object sound signal using the 5.1 multi-channel rendering scheme. As such, when the rendering scheme determined in the stereophonic sound generating apparatus is not to be used, the rendering scheme may be converted into a rendering scheme available in the stereophonic sound reproducing apparatus so as to be used for reproducing the channel sound signal and the object sound signal.

Figure 4A:
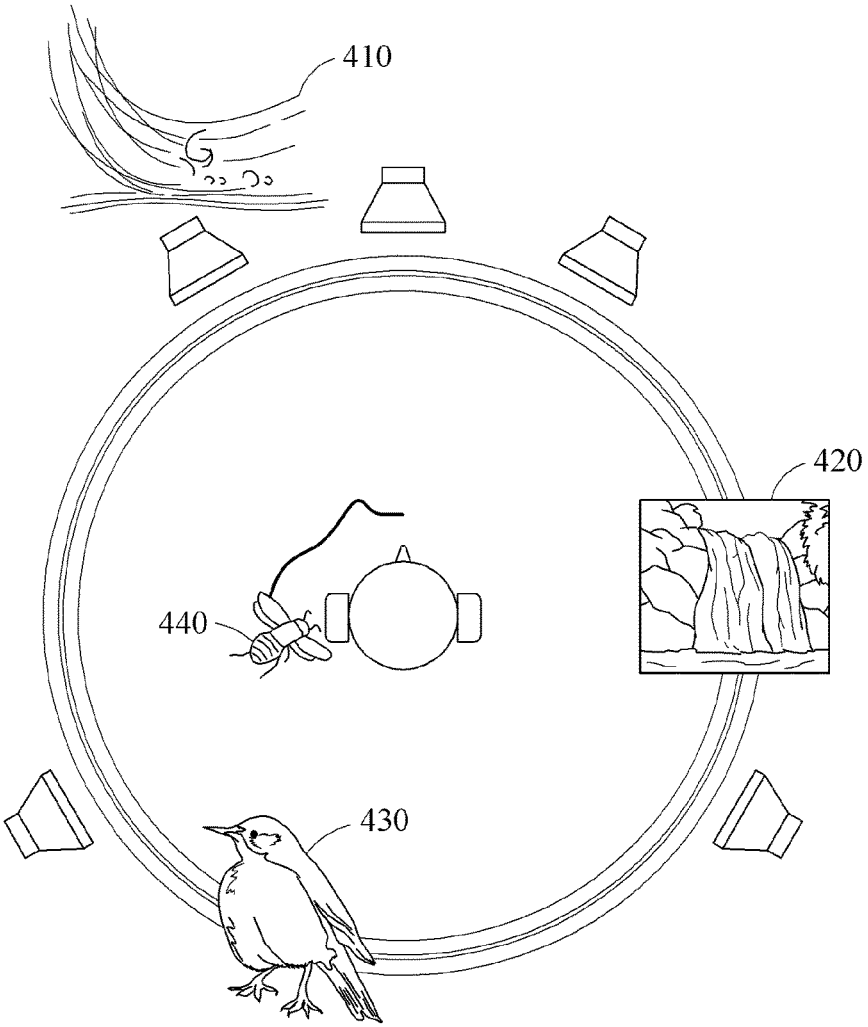
FIGS. 4A and 4B are diagrams illustrating a channel sound signal and an object sound signal using different rendering schemes according to an example embodiment.
Figure 4B:
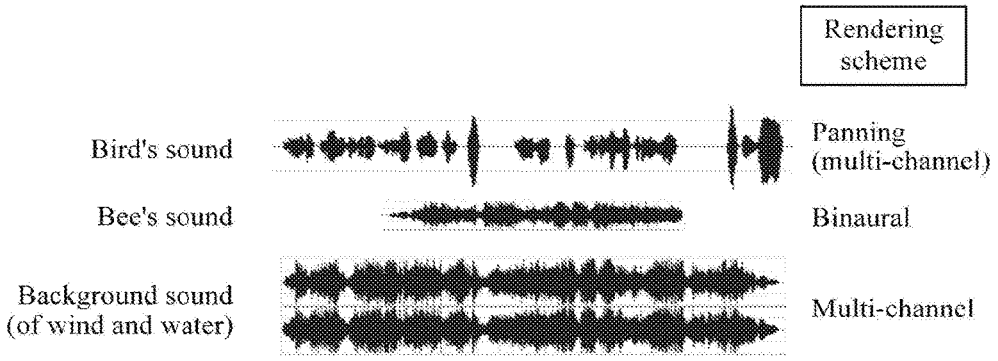

FIGS. 4A and 4B are diagrams illustrating a channel sound signal and an object sound signal using different rendering schemes according to an example embodiment.

FIG. 4A illustrates wind sound 410, water sound 420, bird's sound 430, bee's sound 440 and FIG. 4B illustrates a rendering scheme for each of the wind sound 410, the water sound 420, the bird's sound 430, and the bee's sound 440.

The wind sound 410 and the water sound 420 may be background sound and correspond to channel sound signals. The bird's sound 430 and the bee's sound 440 may correspond to object sound signals 1 and 2. The stereophonic sound generating apparatus may identify each sound such that metadata including a rendering scheme of each sound is transmitted to the stereophonic sound reproducing apparatus.

The channel sound signals corresponding to the wind sound 410 and the water sound 420 may be reproduced using a multi-channel rendering scheme. Although FIG. 4A illustrates that a 5.1 multi-channel rendering scheme is used, the channel sound signals may be converted based on a channel format of the stereophonic sound reproducing apparatus so as to be reproduced.

The object sound signal 1 corresponding to the bird's sound 430 may be reproduced using a multi-channel rendering scheme by panning. Also, the object sound signal 2 corresponding to the bee's sound 440 may be reproduced using a binaural rendering scheme. The object sound signal 2 may be reproduced using the binaural rendering scheme through a headphone, for example, an open headphone, a neckband-type headphone, or a near field speaker with headrest so as to be listened with sound of a multi-channel speaker.

As such a user may listen the wind sound 410 and the water sound 420 through the multi-channel speaker as the background sound, the bird's sound 430 through a multi-channel panning speaker, and the bee's sound 440 through the headphone.

Figure 5A:
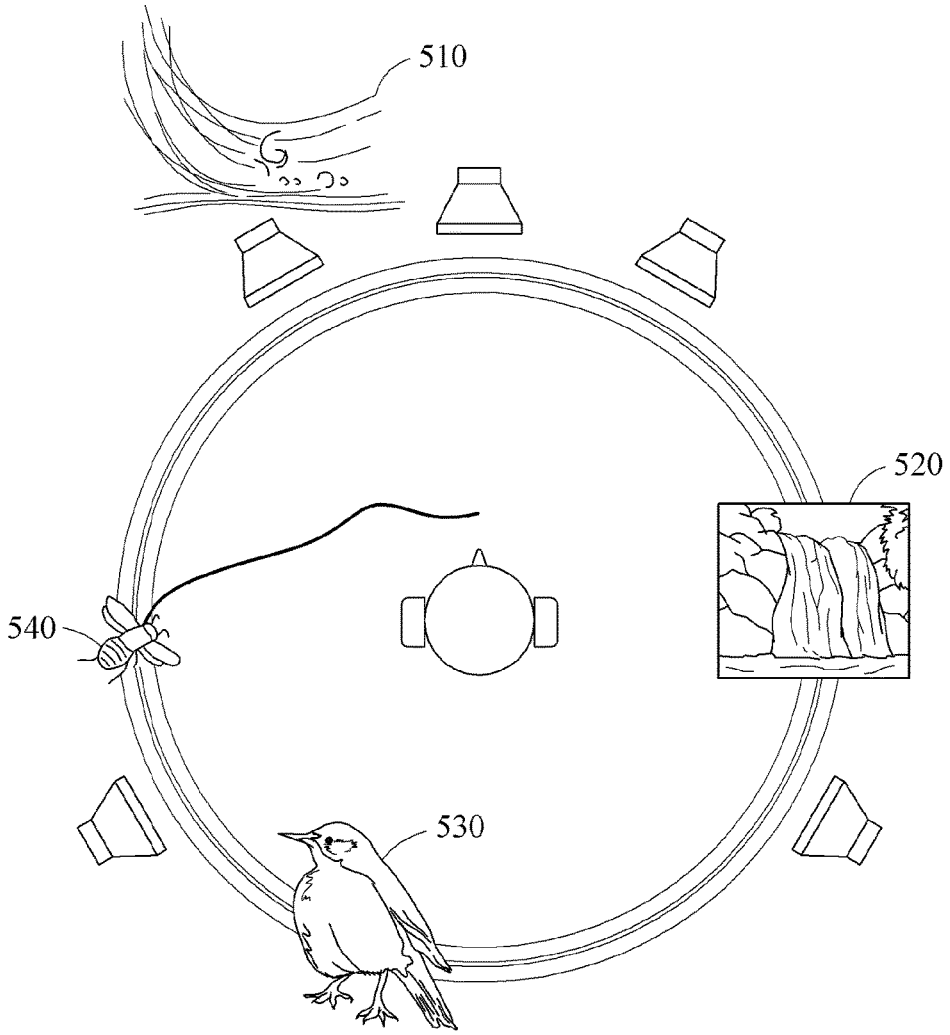
FIGS. 5A and 5B are diagrams illustrating a channel sound signal and an object sound signal reproduced using different rendering schemes according to an example embodiment.
Figure 5B:
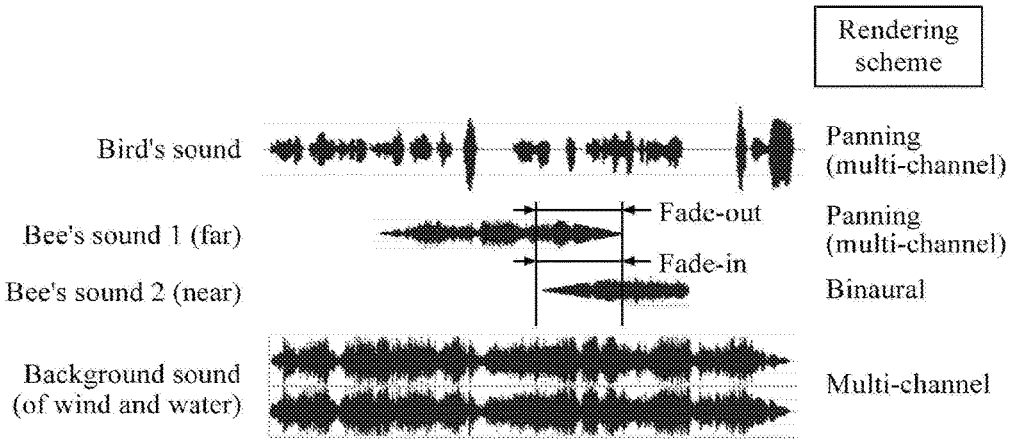

FIGS. 5A and 5B are diagrams illustrating a channel sound signal and an object sound signal reproduced using different rendering schemes according to an example embodiment.

FIG. 5A illustrates wind sound 510, water sound 520, bird's sound 530, and bee's sound 540 and FIG. 5B illustrates a rendering schemes for each of the wind sound 510, the water sound 520, the bird's sound 530, and the bee's sound 540. Unlike the example of FIGS. 4A and 4B, the bee's sound 540 may be reproduced using different rendering schemes on a time-by-time basis while a bee is moving.

For example, bee's sound 1 may be generated when the bee is moving in an area out of a preset range. Also, bee's sound 2 may be generated when the bee is moving in an area within a preset range.

The bee's sound 1 may be reproduced through a multi-channel panning speaker and the bee's sound 2 may be reproduced through a headphone. In this example, when the bee's sound 1 is changed to the bee's sound 2, the rendering scheme may be smoothly changed by fade-in and/or fade-out.

Figure 6:
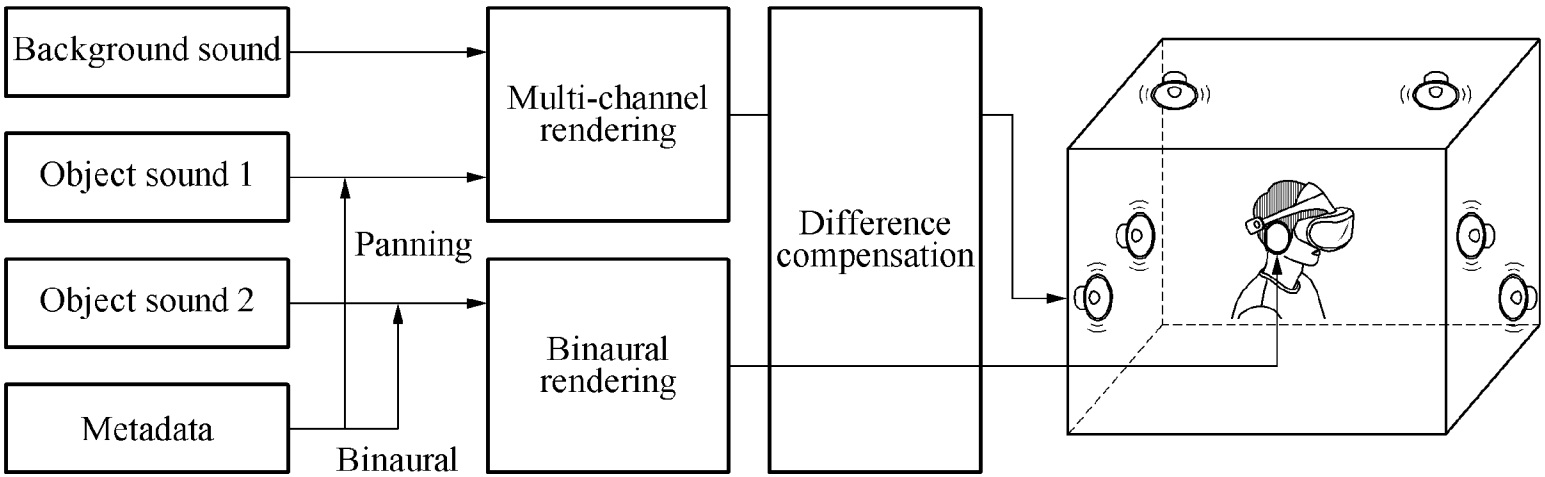
FIG. 6 is a diagram illustrating an example of compensating for a difference due to rendering schemes when reproducing a channel sound signal and an object sound signal according to an example embodiment.

FIG. 6 is a diagram illustrating an example of compensating for a difference due to rendering schemes when reproducing a channel sound signal and an object sound signal according to an example embodiment.

The stereophonic sound reproducing apparatus may reproduce a channel sound signal, an object sound signal, and metadata. The channel sound signal may correspond to background sound. Object sound 1 and object sound 2 may correspond to object sound signals. The metadata may include a rendering scheme of the object sound signal. The metadata may include information for reproducing the object sound 1 using a multi-channel rendering scheme by panning and information for reproducing the object sound 2 using a binaural rendering scheme. Each of the object sound 1 and the object sound 2 may be reproduced using a corresponding rendering scheme based on a movement trajectory of the metadata.

Because a rendering scheme used for reproducing each object sound signal causes a difference, the stereophonic sound reproducing apparatus may compensate for the difference and reproduce the channel sound signal and the object sound signal. The difference may include a latency, a sound volume, and a sound tone but not limited thereto.

When reproducing the object sound 1 using the multi-channel rendering scheme by panning and the object sound 2 using the binaural rendering scheme, the stereophonic sound reproducing apparatus may correct, for example, compensate for a latency caused due to a difference in rendering scheme. For example, a latency caused due to a distance between a multi-channel speaker and a listener in a listening environment may be corrected by adding the latency to the binaural rendering scheme.

When reproducing the object sound 1 using the multi-channel rendering scheme by panning and the object sound 2 using the binaural rendering scheme, the stereophonic sound reproducing apparatus may correct, through equalization, a sound tone changing due to a difference in rendering scheme.

When reproducing the object sound 1 using the multi-channel rendering scheme by panning and the object sound 2 using the binaural rendering scheme, the stereophonic sound reproducing apparatus may correct a sound volume changing due to a difference in rendering scheme. In this example, the stereophonic sound reproducing apparatus may correct the sound volume using a preset reference signal such that the sound volume reproduced using each rendering scheme is equalized. The preset reference signal may be determined by applying a characteristic of the object sound signal.

When a rendering scheme set in the stereophonic sound generating apparatus is inapplicable to the stereophonic sound reproducing apparatus, the stereophonic sound reproducing apparatus may reproduce the channel sound signal and the object sound signal using an available rendering scheme. For example, when a 22.2 multi-channel rendering scheme and the binaural rendering scheme are set in the stereophonic sound generating apparatus and a 5.1 multi-channel rendering scheme is available in the stereophonic sound reproducing apparatus, the stereophonic sound reproducing apparatus may reproduce the channel sound signal and the object sound signal using the 5.1 multi-channel rendering scheme. As such, when the rendering scheme set in the stereophonic sound generating apparatus is not to be used, the rendering scheme may be converted into a rendering scheme available in the stereophonic sound reproducing apparatus so as to be used for reproducing the channel sound signal and the object sound signal.

The components described in the exemplary embodiments of the present invention may be achieved by hardware components including at least one DSP (Digital Signal Processor), a processor, a controller, an ASIC (Application Specific Integrated Circuit), a programmable logic element such as an FPGA (Field Programmable Gate Array), other electronic devices, and combinations thereof. At least some of the functions or the processes described in the exemplary embodiments of the present invention may be achieved by software, and the software may be recorded on a recording medium. The components, the functions, and the processes described in the exemplary embodiments of the present invention may be achieved by a combination of hardware and software.

The processing device described herein may be implemented using hardware components, software components, and/or a combination thereof. For example, the processing device and the component described herein may be implemented using one or more general-purpose or special purpose computers, such as, for example, a processor, a controller and an arithmetic logic unit (ALU), a digital signal processor, a microcomputer, a field programmable gate array (FPGA), a programmable logic unit (PLU), a microprocessor, or any other device capable of responding to and executing instructions in a defined manner. The processing device may run an operating system (OS) and one or more software applications that run on the OS. The processing device also may access, store, manipulate, process, and create data in response to execution of the software. For purpose of simplicity, the description of a processing device is used as singular; however, one skilled in the art will be appreciated that a processing device may include multiple processing elements and/or multiple types of processing elements. For example, a processing device may include multiple processors or a processor and a controller. In addition, different processing configurations are possible, such as parallel processors.

The methods according to the above-described example embodiments may be recorded in non-transitory computer-readable media including program instructions to implement various operations of the above-described example embodiments. The media may also include, alone or in combination with the program instructions, data files, data structures, and the like. The program instructions recorded on the media may be those specially designed and constructed for the purposes of example embodiments, or they may be of the kind well-known and available to those having skill in the computer software arts. Examples of non-transitory computer-readable media include magnetic media such as hard disks, floppy disks, and magnetic tape; optical media such as CD-ROM discs, DVDs, and/or Blue-ray discs; magneto-optical media such as optical discs; and hardware devices that are specially configured to store and perform program instructions, such as read-only memory (ROM), random access memory (RAM), flash memory (e.g., USB flash drives, memory cards, memory sticks, etc.), and the like. Examples of program instructions include both machine code, such as produced by a compiler, and files containing higher level code that may be executed by the computer using an interpreter. The above-described devices may be configured to act as one or more software modules in order to perform the operations of the above-described example embodiments, or vice versa.

A number of example embodiments have been described above. Nevertheless, it should be understood that various modifications may be made to these example embodiments. For example, suitable results may be achieved if the described techniques are performed in a different order and/or if components in a described system, architecture, device, or circuit are combined in a different manner and/or replaced or supplemented by other components or their equivalents. Accordingly, other implementations are within the scope of the following claims.

What is claimed is:

1. A stereophonic sound reproducing method performed by a stereophonic sound reproducing apparatus, the method comprising:

receiving a channel sound signal based on a channel, an object sound signal based on an object, and metadata;

determining a rendering scheme based on a characteristic of the object sound signal;

reproducing the channel sound signal based on a preset rendering scheme; and reproducing the object sound signal based on the metadata including the determined rendering scheme.

2. The stereophonic sound reproducing method of claim 1, wherein the determined rendering scheme is changed on a time-by-time basis while the object sound signal is reproduced.

3. The stereophonic sound reproducing method of claim 1, wherein the reproducing comprises compensating for a latency due to a difference in rendering scheme of the object sound signal.

4. The stereophonic sound reproducing method of claim 1, wherein the reproducing comprises correcting a sound tone change and a sound volume change due to a difference in rendering scheme of the object sound signal.

5. The stereophonic sound reproducing method of claim 1, wherein the preset rendering scheme of the channel sound signal includes a channel format for reproducing the channel sound signal, and the channel format is converted based on a reproduction environment.

6. A stereophonic sound generating method performed by a stereophonic sound generating apparatus, the method comprising:

identifying a channel sound signal based on a channel and an object sound signal based on an object;

determining a rendering scheme based on a characteristic of the identified object sound signal; and generating metadata including the determined rendering scheme.

7. The stereophonic sound generating method of claim 6, wherein the determined rendering scheme is changed on a time-by-time basis while the object sound signal is reproduced.

8. The stereophonic sound generating method of claim 7, wherein the determined rendering scheme is changed based on a movement of an object corresponding to a target of the object sound signal.

9. A stereophonic sound reproducing apparatus comprising:

a processor configured to:

receive a channel sound signal based on a channel, an object sound signal based on an object, and metadata;

determine a rendering scheme based on a characteristic of the object sound signal;

reproduce the channel sound signal based on a preset rendering scheme; and reproduce the object sound signal based on the metadata including the determined rendering scheme.

10. The stereophonic sound reproducing apparatus of claim 9, wherein the processor is configured to change the determined rendering scheme on a time-by-time basis while the object sound signal is reproduced.

11. The stereophonic sound reproducing apparatus of claim 9, wherein in response to reproducing the object sound signal, the processor is configured to compensate for a latency due to a difference in rendering scheme of the object sound signal.

12. The stereophonic sound reproducing apparatus of claim 9, wherein when reproducing the object sound signal, the processor is configured to correct a sound tone change and a sound volume change due to a difference in rendering scheme of the object sound signal.

13. The stereophonic sound reproducing apparatus of claim 9, wherein the processor is configured to perform conversion, based on a reproduction environment, on a channel format included in the preset rendering scheme of the channel sound signal.

* * * * *